US009297175B2

(12) United States Patent
Jarvinen

(10) Patent No.: US 9,297,175 B2
(45) Date of Patent: Mar. 29, 2016

(54) CAP FOR LIFT HOLE

(71) Applicant: ELEMATIC OY AB, Akaa (FI)

(72) Inventor: Lassi Jarvinen, Valkeakoski (FI)

(73) Assignee: ELEMATIC OYJ, Akaa (FI)

( * ) Notice: Subject to any disclaimer, the term of this patent is extended or adjusted under 35 U.S.C. 154(b) by 0 days.

(21) Appl. No.: 14/548,681

(22) Filed: Nov. 20, 2014

(65) Prior Publication Data

US 2015/0143752 A1 May 28, 2015

(30) Foreign Application Priority Data

Nov. 22, 2013 (FI) ..... 20136169

(51) Int. Cl.

| | |
|---|---|
| ***E04G 21/14*** | (2006.01) |
| ***E04C 2/04*** | (2006.01) |
| ***B28B 23/00*** | (2006.01) |
| ***E04B 1/41*** | (2006.01) |
| ***E04G 21/24*** | (2006.01) |

(52) U.S. Cl.

CPC ..... *E04G 21/142* (2013.01); *B28B 23/005* (2013.01); *E04B 1/41* (2013.01); *E04C 2/044* (2013.01); *E04G 21/145* (2013.01); *E04G 21/24* (2013.01)

(58) Field of Classification Search

CPC ..... E04G 21/142; E04G 21/14; E04C 2/044; B28B 23/005

USPC ..... 52/125.5, 125.6

See application file for complete search history.

(56) References Cited

U.S. PATENT DOCUMENTS

| | | | | |
|---|---|---|---|---|
| 3,298,148 | A | 1/1967 | Rufus | |
| 4,383,692 | A * | 5/1983 | Proctor | 277/606 |
| 4,559,025 | A * | 12/1985 | Dore | 464/175 |
| 4,625,877 | A * | 12/1986 | Hoch | 215/366 |
| 4,991,457 | A * | 2/1991 | Chen | 74/473.36 |
| 5,528,867 | A | 6/1996 | Thompson | |
| 5,535,900 | A * | 7/1996 | Huang | 215/228 |
| 5,851,476 | A * | 12/1998 | Wydra et al. | 264/507 |
| 6,651,834 | B2 * | 11/2003 | Wong | 215/260 |
| 7,048,136 | B2 * | 5/2006 | Havens et al. | 220/212 |
| 7,097,563 | B2 * | 8/2006 | Benson et al. | 464/17 |
| 7,222,460 | B2 | 5/2007 | Francies | |
| 2005/0072475 | A1 * | 4/2005 | Seo | 137/512.15 |

(Continued)

FOREIGN PATENT DOCUMENTS

| | | |
|---|---|---|
| DE | 1684247 | 3/1971 |
| EP | 1878854 A2 | 7/2007 |

(Continued)

OTHER PUBLICATIONS

Finnish Office Action for Patent Application 20136169 dated Aug. 11, 2014.

(Continued)

*Primary Examiner* — Jerry Redman

(74) *Attorney, Agent, or Firm* — Dickinson Wright PLLC

(57) ABSTRACT

A cap for covering a lift hole of a lifting lug of a concrete slab, which cap comprises a flat circular skirt and a central portion, wherein from the lower surface of the flat skirt extends one continuous circular protrusion or a plurality of smaller protrusions in circular formation, wherein the central portion extends upwards from the skirt and is formed to be pressed down so that the upper part of the lifting lug breaks through the central portion.

7 Claims, 3 Drawing Sheets

(56) References Cited

U.S. PATENT DOCUMENTS

| | | | | |
|---|---|---|---|---|
| 2005/0096605 | A1* | 5/2005 | Green et al. | 604/246 |
| 2007/0007309 | A1* | 1/2007 | Eberhardt | 222/402.13 |
| 2007/0205224 | A1* | 9/2007 | Glynn et al. | 222/211 |
| 2008/0104897 | A1 | 5/2008 | Lang | |
| 2008/0231003 | A1* | 9/2008 | Moriyama et al. | 277/636 |
| 2008/0277503 | A1* | 11/2008 | Griffin | 239/525 |
| 2009/0092436 | A1* | 4/2009 | Mercier | 401/122 |
| 2009/0100768 | A1 | 4/2009 | Baur | |
| 2014/0144329 | A1* | 5/2014 | Chiu | 99/277.1 |
| 2015/0184614 | A1* | 7/2015 | Langenfeld et al. | |

FOREIGN PATENT DOCUMENTS

| | | | |
|---|---|---|---|
| EP | 2644803 | A2 * | 10/2013 |
| SU | 554163 | | 4/1977 |
| WO | 0244495 | A1 | 6/2002 |
| WO | 2007143784 | A1 | 12/2007 |
| WO | 2008025894 | A2 | 3/2008 |

OTHER PUBLICATIONS

International Search Report issued on corresponding EP141990228.8 on Oct. 6, 2015.

* cited by examiner

CAP FOR LIFT HOLE

This application claims benefit of the filing date of Finnish Patent Application Serial No. 20136169, filed 22 Nov. 2013.

BACKGROUND

1. Field

The present disclosure relates to a cap, which covers a lift hole of a lifting lug of a hollow slab.

2. Description of Related Art

For lifting and moving of hollow-core slabs and massive slabs it is often necessary to provide the ready cast slabs with lifting lugs. Lifting lugs are positioned to the cast hollow-core slab at the hollow cores as shown in the EP 1878854 or on the bracket between the hollow cores as shown in the FR 2905397, whereby the upper surface of the slab is removed at a predetermined place and predetermined length at the hollow core or the bracket of the hollow-core slab, the opened ends of the hollow core are plugged, e.g., by means of plugs made of plastic or by means of added concrete mass, and the lifting lug is positioned to the provided space.

At the construction site, the ready cast slabs with lifting lugs are mounted in their places, where the space of the hollow-core slabs defined by the plugs is filled with concrete mass up to the level of the upper surface of the hollow-core slab. The lifting lug comprises a cup-like portion having its upper edges limited to the level of the upper surface of the hollow-core slab, and the lug portion of the lifting lug sets itself substantially in the middle of the cup, so that the uppermost part thereof is located substantially at the level of the upper surface of the cast hollow-core slab.

There is a problem when the space of the lifting lugs is filled with concrete mass. The concrete mass spreads into cavities of the hollow-core slabs by partially filling the cavities that will make the structure of the hollow-core slabs heavier. And when the concrete mass spreads into the cavities of the hollow-core slabs, more filling concrete mass is needed.

There is a known solution for the cap where the cap is mounted at the cast slab during its manufacture through the lifting lug, in which the lifting lug is positioned on the bracket between the cavities of the hollow-core slab. The cap has upwards directed bristles which block the flow of the filling concrete mass into the cavities in a lateral direction, and the bracket of the hollow-core slab blocks the flow of the filling concrete mass in a downward direction.

There is another problem when then hollow-core slabs are stored outdoors. The lift hole of the lifting lug is exposed to environmental influences because the hole is uncovered. When it's raining or snowing, water and snow gets into the cavities of the hollow-core slabs causing problems in the long run, such as corrosion and erosion, for example.

SUMMARY

According to an embodiment of the present invention, the cap for the lift hole covers the hole wherein the lifting lug is positioned in the hollow-core slab. The cap is mounted in the lift hole after the lifting lugs are mounted to the cast hollow-core slab. The cap for covering the lift hole of the lifting lug of the concrete slab comprises a flat circular skirt and an upwards extending central portion. From the lower surface of the flat skirt extends one continuous circular protrusion or a plurality of smaller protrusions in circular formation. The protrusion or protrusions advantageously provides a compressive stress against the edges of the hole, when the cap is held in place within the hole. The central portion extends upwards from the skirt, when the solution according to the present invention blocks the water and snow from getting into the cavities of the slabs.

The central portion of the cap is formed to be pressed down when the lifting lugs are to be used so that the upper part of the lifting lug breaks through the central portion, and a lifting hook can be fixed through the lifting lug for lifting and moving of hollow-core slabs. When the hollow-core slab is positioned at its final installation place, the pressed-down central portion of the cap is cast with filling concrete mass up to the level of the upper surface of the hollow-core slab. Thus the pressed down portion of the cap blocks the filling concrete mass from getting into the cavities of the hollow-core slab. The height of the central portion of the cap is defined to be such, that when pressed down there is sufficient room between the surface of the central portion and the upper portion of the lifting lug for inserting lifting hook to the lifting lug.

The cap of an embodiment of the invention is advantageously formed of a suitable plastic material, which due to its elasticity and flexibility allows the central portion of the cap to be easily pressed down.

The central portion of the cap has advantageously a spherical form. The form may also comprise other shapes, as long as the shape can be pressed down below the level of the skirt.

Advantageously, the central portion comprises a section for facilitating the breaking of the area for the lifting lug. The section may comprise thinner material thickness and/or a cut. This embodiment helps pressing down the central portion for example by hand or with suitable tools so that the upper part of the lifting lug can easily break through the central portion.

In another embodiment, the central portion consists of two or more at least partly overlapping sections. The sections are formed to be pressed down so that the sections slide relative to each other when the upper part of the lifting lug breaks through the central portion.

Advantageously, the cap comprises a circular sealing protrusion on the lower surface of the flat skirt. The circular sealing protrusion provides a sealing surface between the lower surface of the flat skirt and the upper surface of the hollow-core slab, where the sealing protrusion enhances the blocking of water and snow from getting into the cavities of the slabs. The sealing protrusion may be formed of the same material than the cap itself, or different material for the sealing protrusion may be used, such as rubber. Thus the sealing surface may be formed of a separate piece which is the fixed to the cap.

More precisely, the features of a cap in accordance with an embodiment of the invention relate to a cap for covering a lift hole of a lifting lug of a concrete slab, which cap comprises a flat circular skirt and a central portion, wherein from the lower surface of the flat skirt extends one continuous circular protrusion or a plurality of smaller protrusions in circular formation, characterized in that the central portion extends upwards from the skirt and is formed to be pressed down so that the upper part of the lifting lug breaks through the central portion.

BRIEF DESCRIPTION OF DRAWINGS

The embodiments of the invention will be described in more detail by means of example in the following, with reference to the enclosed drawings, wherein.

DETAILED DESCRIPTION OF SPECIFIC EMBODIMENTS

Figure 1:
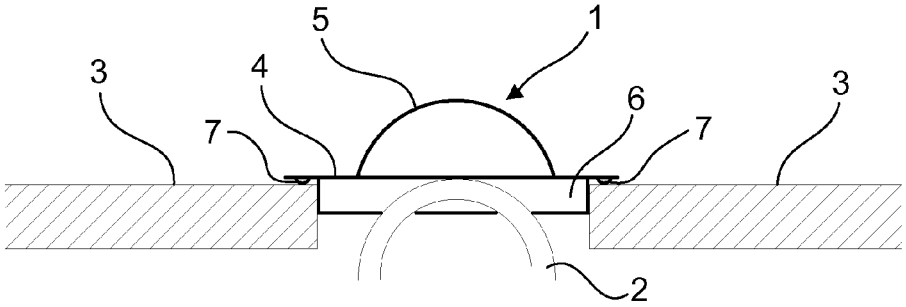
FIG. 1 shows schematically one embodiment of a cap of the invention for a lift hole in cross-section.
Figure 2:
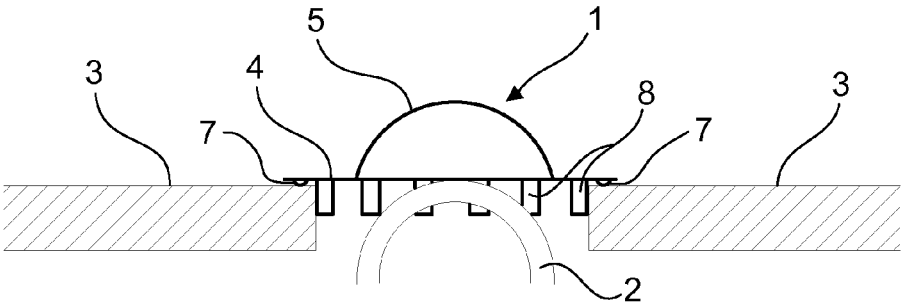
FIG. 2 shows schematically one alternative embodiment of a cap of the invention for a lift hole in cross-section.
Figure 3:
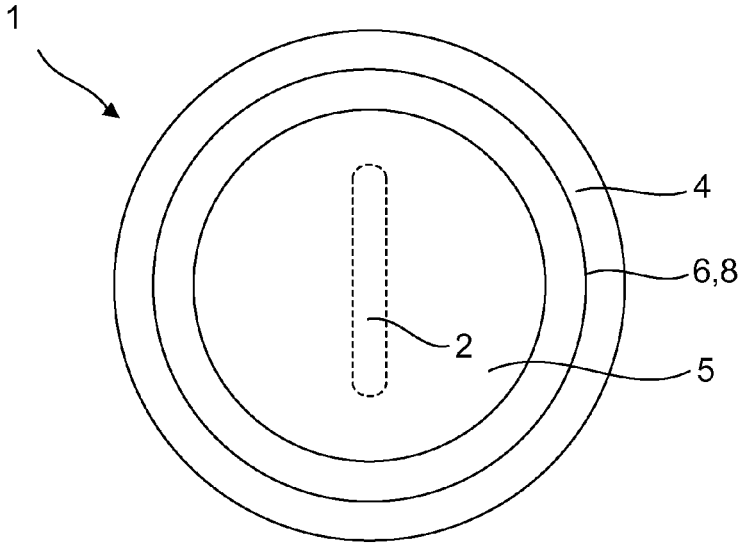
FIG. 3 shows schematically the cap of FIGS. 1 and 2 in a plan view.

In the FIGS. 1-3, the cap 1 covers the hole wherein the lifting lug 2 is positioned in the hollow-core slab 3. The cap of an embodiment of the present invention blocks the water and snow from getting into the cavities of the slabs 3.

In the FIG. 1, a cap 1 for the lift hole of a lifting lug 2 of a concrete slab 3 is shown. The cap 1 comprises a flat circular skirt 4, an upwards extending central portion 5, a continuous circular protrusion 6 in circular formation, which extends from the lower surface of the flat skirt 4, and a circular sealing protrusion 7 on the lower surface of the flat skirt 4.

The form of the central portion 5, which extends upwards from the skirt 4, blocks the water and snow from getting into the cavities of the slabs 3. Also, the circular sealing protrusion 7 enhances the blocking of water and snow from getting into the cavities of the slabs 3. The circular sealing protrusion 7 provides a sealing surface between the lower surface of the flat skirt 4 and the upper surface of the hollow-core slab 3.

In the FIG. 2, the continuous circular protrusion 6 as shown in FIG. 1 is in this embodiment provided as a plurality of smaller protrusions 8 in circular formation, which protrusions 8 extend downwards from the lower surface of the flat skirt 4. The protrusions 6, 8 provide a compressive stress against the edges of the hole, when the cap 1 is held in place within the hole.

In the FIG. 3 is shown the form of the cap 1 which is advantageously circular.

Figure 4:
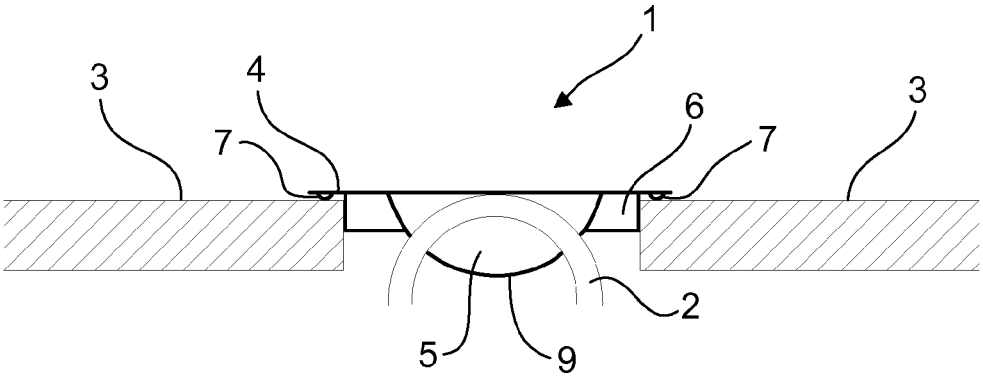
FIG. 4 shows schematically one embodiment of a pressed down cap of the invention in cross-section.

In the FIG. 4, the central portion 5 is pressed down so that the upper part of the lifting lug 2 has broken through the central portion 5. In this position a lifting hook (not shown) can be fixed through the lifting lug 2 for lifting and moving of the hollow-core slabs 3. As can be seen from the figure, in this position the central portion 5 forms a cup form 9 below and around the upper portion of the lifting lug 2. When the hollow-core slab 3 is positioned at its final installation place, the pressed-down central portion 5 of the cap 1 is filled with filling concrete mass up to the level of the upper surface of the hollow-core slab 3. The pressed-down central portion 5 of the cap 1 blocks the filling concrete mass from getting into the cavities of the slabs 3.

Figure 5:
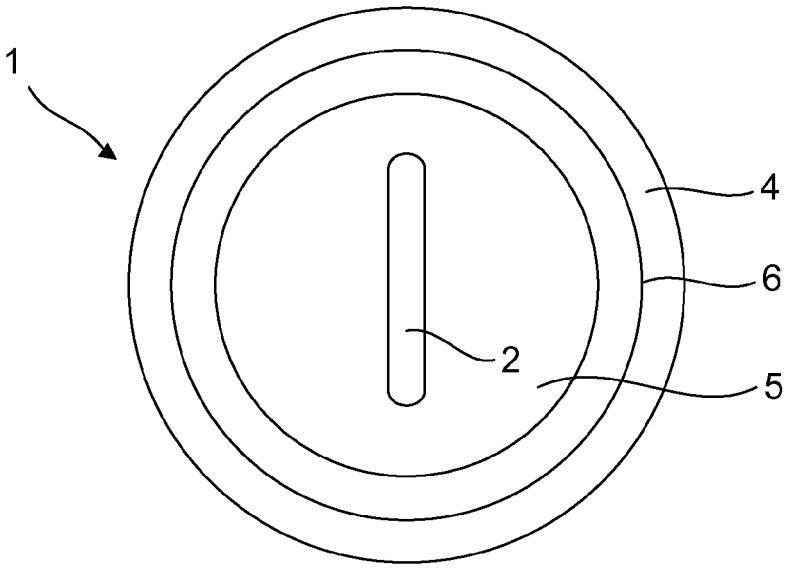
FIG. 5 shows schematically the pressed down cap of FIG. 4 in a plan view.

In the FIG. 5 is shown the form of the pressed down cap 1, which is advantageously of a circular shape.

Figure 6:
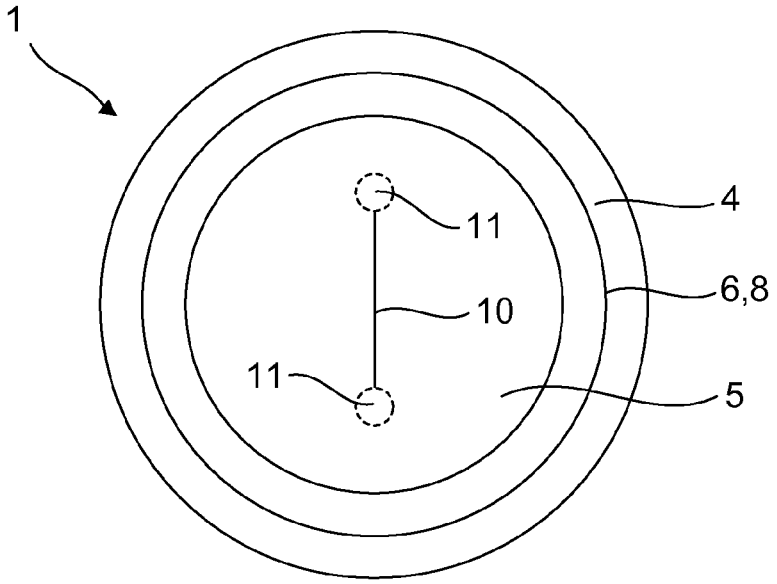
FIGS. 6 and 7 show schematically alternative embodiments of a cap of the invention for a lift hole in a plan view.

In the embodiment of FIG. 6, in the central portion 5 of the cap 1 is formed a cut 10, through which the upper portion of a lifting lug can easily penetrate the central portion 5. At both ends of the cut 10 are formed areas 11 having thinner material thickness, and/or perforation at the edge of these areas 11, so that material on these areas 11 can be easily broken. Once the central portion 5 is pressed down and around the upper portion of the lifting lug, the metal bar forming the lifting lug sets at the areas 11, so that the edges of the cut 10 can return against each other.

Figure 7:
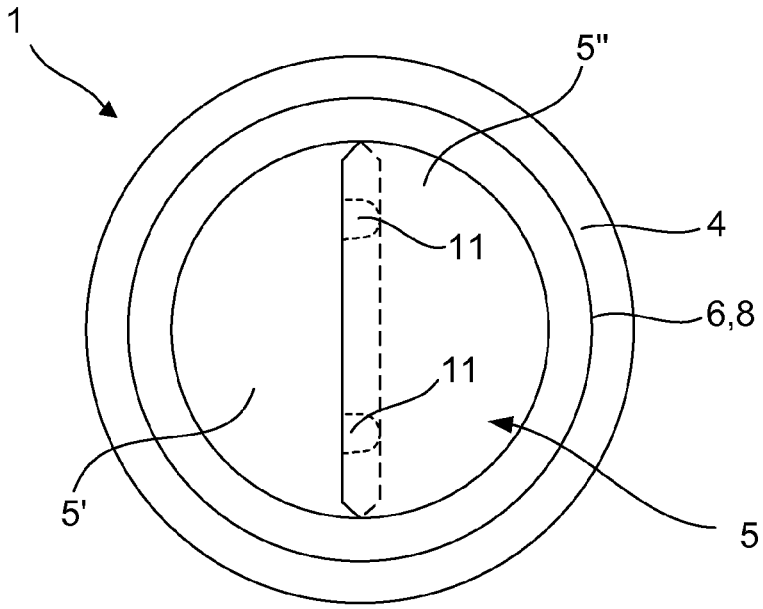

In the embodiment of FIG. 7, the central portion 5 of the cap 1 is formed from of two partly overlapping sections 5' and 5". When the central portion 5 is pressed down the upper portion of a lifting lug can penetrate the central portion 5 through the overlapping area. Either in the upper overlapping section 5" or in both overlapping sections 5' and 5" are formed areas 11 having thinner material thickness, and/or perforation at the edge of these areas 11, so that material on these areas 11 can be easily broken. Once the central portion 5 is pressed down and around the upper portion of the lifting lug, the metal bar forming the lifting lug sets at the areas 11, so that the edges of the overlapping sections 5' and 5" can return against each other.

In the embodiments of the figures, the cap 1 is produced from suitable plastic allowing suitable elasticity and flexibility for the central portion 5 to be pressed down. The cap 1 can be produced as a single piece, or as separate pieces fixed together.

With regard to the foregoing examples, it is obvious that these are subject to a multitude of modifications and variations within the scope of the invention, as evident for a person skilled in the art. Therefore, the foregoing embodiments of the invention are by no means limitative regarding the invention, but the scope of protection for the invention is solely defined in accordance with the appended claims.

The invention claimed is:

1. A cap for covering a lift hole of a lifting lug of a concrete slab, comprising:

a flat circular skirt comprising a lower surface, and a central portion, wherein from the lower surface of the flat circular skirt extends one continuous circular protrusion, or a plurality of smaller protrusions in circular formation, wherein the central portion extend upwards from the flat circular skirt in an initial position and is pressed down below the flat circular skirt in a final position, so that in use with a lifting lug of a concrete slab, an upper part of the lifting lug of a concrete slab breaks through the central portion in the final position.

2. The cap according to claim 1, wherein the central portion has a spherical form.

3. The cap according to claim 1, wherein the central portion comprises a section for facilitating breaking in an area of the lifting lug of a concrete slab.

4. The cap according to claim 3, wherein the section for facilitating the breaking in an area of the lifting lug of a concrete slab comprises a thinner material thickness or a cut, or a combination thereof.

5. The cap according to claim 1, wherein the central portion has a plurality of at least partly overlapping sections.

6. The cap according to claim 5, wherein the at least partly overlapping sections are adapted to be pressed down so that the sections slide relative to each other when the upper part of the lifting lug of a concrete slab breaks through the central portion.

7. The cap according to claim 1, wherein the cap comprises a circular sealing protrusion on the lower surface of the flat circular skirt.

* * * * *